US010086503B2

(12) United States Patent
Sun

(10) Patent No.: US 10,086,503 B2
(45) Date of Patent: Oct. 2, 2018

(54) MULTIFUNCTIONAL SCREWDRIVER

(71) Applicant: Shanghai Easy-Use Tools Enterprise Co. Ltd., Shanghai (CN)

(72) Inventor: Shiyu Sun, Shanghai (CN)

(73) Assignee: SHANGHAI EASY-USE TOOLS ENTERPRISE CO. LTD., Shanghai (CN)

( * ) Notice: Subject to any disclaimer, the term of this patent is extended or adjusted under 35 U.S.C. 154(b) by 92 days.

(21) Appl. No.: 15/258,870

(22) Filed: Sep. 7, 2016

(65) Prior Publication Data

US 2017/0209989 A1 Jul. 27, 2017

(30) Foreign Application Priority Data

Jul. 8, 2015 (CN) ..... 2015 2 0490190 U

(51) Int. Cl.
*B25B 15/04* (2006.01)
*B25B 23/00* (2006.01)

(52) U.S. Cl.
CPC ..... *B25B 15/04* (2013.01); *B25B 23/0007* (2013.01)

(58) Field of Classification Search
CPC ..... B25B 15/04; B25B 23/0007
USPC ..... 81/60, 177.2
See application file for complete search history.

(56) References Cited

U.S. PATENT DOCUMENTS 440,435 A * 11/1890 O'Neill ..... B25B 13/14 81/133
2,620,001 A * 12/1952 Fratz ..... B25B 23/16 221/229
3,654,975 A * 4/1972 Ballsmith ..... B25B 13/463 81/32
4,748,874 A * 6/1988 Sharp ..... B25B 13/461 81/177.2
6,286,395 B1 * 9/2001 Frazier ..... B25B 13/005 81/124.7
7,444,908 B2 * 11/2008 Lin ..... B25G 1/105 81/177.2

* cited by examiner

*Primary Examiner* — Hadi Shakeri
(74) *Attorney, Agent, or Firm* — Ming Chow; Sinorica LLC

(57) ABSTRACT

A multifunctional screwdriver has a ratchet head, a matching shaft and a handle. The ratchet head has a center, a bottom side, a peripheral side, an upper side, a plurality of flanges, a plurality of grooves, a matching hole, two circular holes and a protrusion. The matching shaft has a first end, a second end, two embossments and a connecting hole. The handle has a front end surface, a back end surface, a mounting hole and a shape-matching hole.

4 Claims, 3 Drawing Sheets

MULTIFUNCTIONAL SCREWDRIVER

CROSS-REFERENCE TO RELATED APPLICATIONS

The present application claims priority to and the benefit of Chinese Patent Application No. CN 201520490190.X, filed on Jul. 8, 2015, the entire content of which is incorporated herein by reference.

BACKGROUND OF THE INVENTION

1. Field of the Invention

The present patent application relates to the field of daily hardware, more specifically, to multifunctional screwdriver.

2. Description of the Related Art

The existing screwdriver provides a lot of conveniences to people's life, which is mainly used to fasten or loosen the screws. The structure of the most common screwdriver in prior art generally includes a screwdriver handle, a screwdriver rod and a screwdriver head, and the screwdriver, screwdriver rod and screwdriver head are fixed as an one-piece structure. When using the screwdriver, the user has to constantly loose or clench the palm of his/her hands, which allows the palm to be located at a position easy to apply force. When the user are loosing or clench the palm, the screwdriver head is easily separated from the screw, so it is very inconvenient to operate the screwdriver.

SUMMARY OF THE PATENT APPLICATION

In view of this, the present patent application provides a multifunctional screwdriver, in order to solve the problem that the conventional screwdrivers are not convenient for use in prior art.

In order to achieve the objectives mentioned above, the technical proposals of the present patent application are realized as follows:

A multifunctional screwdriver, comprising:

a ratchet head, in which a matching hole is provided, the matching hole being configure with two circular holes opposite to each other at interior of center of the ratchet head, and the ratchet head being provided with a protrusion at its bottom;

a matching shaft, an embossment being provided at two sides of one end of the matching shaft, and a connecting hole being provided at the other end of the matching shaft;

a handle, front end surface of the handle is provided with a mounting hole matched with said matching shaft, and back end surface of the handle is provided with a shape-matching hole;

wherein, one end of the matching shaft which has said embossment is connectable to the ratchet head, the embossment is inserted in the circular hole, and the protrusion is connectable to the shape-matching hole.

Preferably, the multifunctional screwdriver as disclosed above, wherein said handle has a columnar structure in direction of length, and one end of the handle is concave and curved inwards.

Preferably, the multifunctional screwdriver as disclosed above, wherein said matching hole is matched with said matching shaft in diameter size.

Preferably, the multifunctional screwdriver as disclosed above, wherein id shape-matching hole is matched with said protrusion in size.

Preferably, the multifunctional screwdriver as disclosed above, wherein a plurality of flange structures are provided at periphery of the ratchet head, a plurality of grooves are formed between each two of the flange structures which are adjacent to each other, and the matching hole is located in one of said grooves.

Since the present patent application adopts the mentioned-above technical proposals, positive effects can be achieved as follows:

In the present patent application, the ratchet head and the handle of the screwdriver can be connected by various coordination modes, one end of the connecting hole is connected with the handle, and one end of the protrusion is connected with the ratchet head, and the matching shaft can rotate relative to the ratchet head by 90 degree, namely it can fasten the screwdriver in the vertical direction, and also can increase the torque of the screwdriver, reduce the power output from users, and thus save physical capacity; through the installation of the protrusion and the matching hole, it allows the user to use the screwdriver in narrow working environment, for example, to hold the handle and rotate the handle, which is easy to operate. The ratchet head can be matched with the handle and then used as a ratchet wrench, and can also be singly used as a palm ratchet wrench; the ratchet head can be matched with the handle and then used as a screwdriver.

BRIEF DESCRIPTIONS OF THE DRAWINGS

Accompanying drawings constituting part of the present patent application is provided for further comprehension of the present patent application, the present patent application of exemplary embodiments and illustration thereof are provided to explain the present patent application, which does not limit the scope of the present patent application. In the accompanying drawings.

DESCRIPTIONS OF THE PREFERRED EMBODIMENTS

Figure 1:
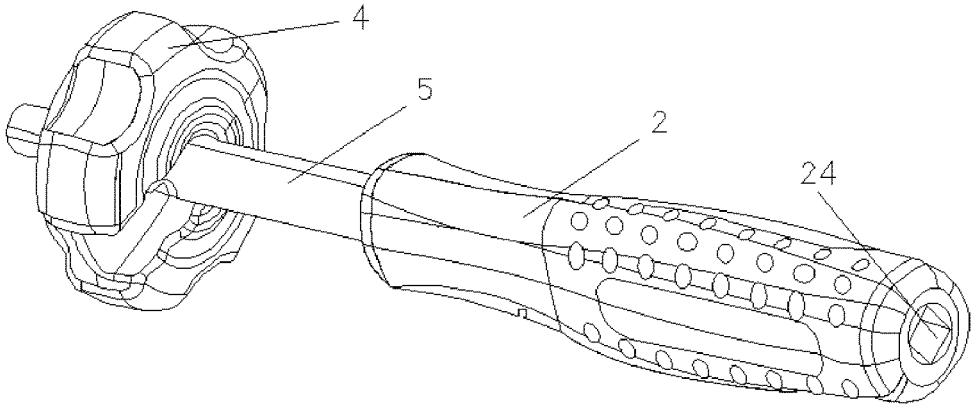
FIG. 1 shows an assembly diagram of the ratchet head and the handle of the multifunctional screwdriver of the present patent application.

Hereinafter, certain embodiments according to the present patent application will be described with reference to the accompanying drawings below, but do not limit the scope of the present patent application.

Embodiments

Please refer to FIGS. 1 to 5, the multifunctional screwdriver of the present patent application is characterized in that it comprises:

A ratchet head 4, a plurality of flange structures 11 being provided at periphery of the ratchet head 4, a plurality of grooves 12 being formed between each two of the flange structures 11 which are adjacent to each other, and one of said grooves 12 being provided with a gap structure 41 inside, the gap structure 41 being provided with two circular holes 42 which is inside the gap structure 41 and opposite to each other being located at center of the ratchet head 4, and the ratchet head 4 being provided with a protrusion 14 at its bottom;

A matching shaft 5, two sides at one end of the matching shaft 5 being provided with an embossment 51, and the other end of the matching shaft 5 being provided with a connecting hole 31;

A handle 2, the front end surface of the handle 2 is provided with a mounting hole (not shown) matchable with the structure of the matching shaft 5, and the back end surface of the handle 2 is provided with a shape-matching hole 24;

wherein, one end of the matching shaft 5 which has said embossment 51 is connectable to the ratchet head 4, the embossment 51 is inserted in the circular hole 42, and the protrusion 14 is connectable to the shape-matching hole 24 in the handle 2.

On the basis of the above, the present patent application also provides the following embodiments, please continue referring to FIGS. 1 to 5, In a further embodiment of the present patent application, the handle 2 has a columnar structure in the direction of the length, and one end of the handle is concave and curved inwards.

In a further embodiment of the present patent application, the diameter of the gap structure 41 is matched with the diameter of the matching shaft 5.

In a further embodiment of the present patent application, the size of the shape-matching hole 24 structure is matched with the size of the protrusion 14.

Figure 2:
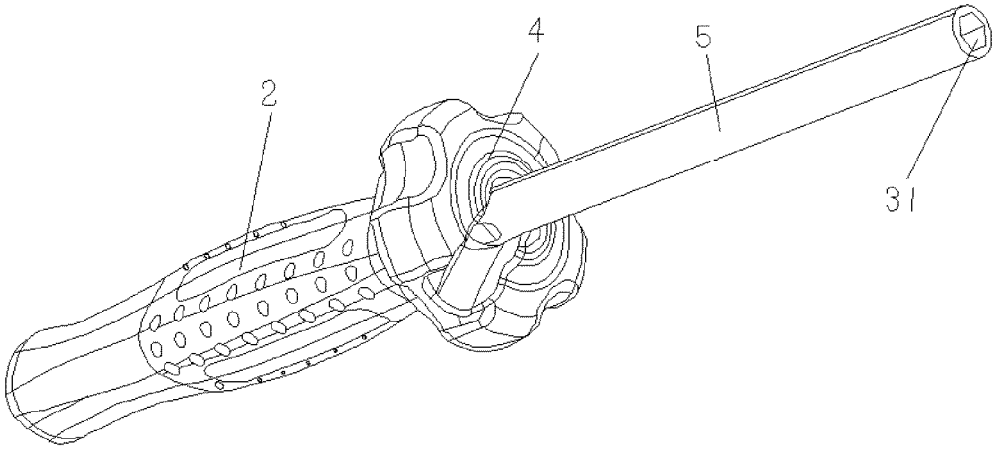
FIG. 2 shows another assembly diagram of the ratchet head and the handle of the multifunctional screwdrivers of the present patent application.
Figure 3:
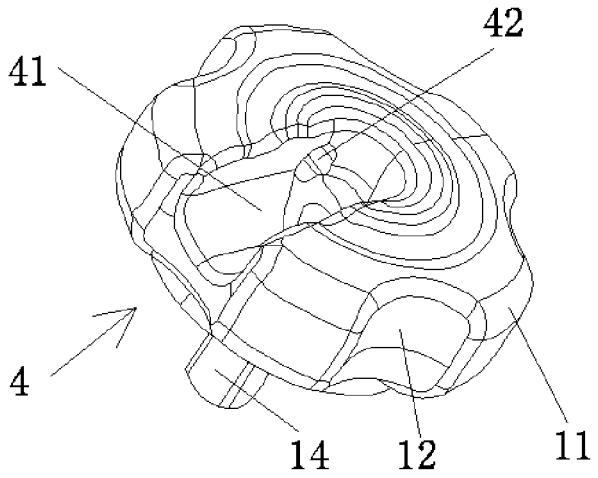
FIG. 3 shows a structure diagram of the ratchet head of the multifunctional screwdriver of the present patent application.
Figure 4:
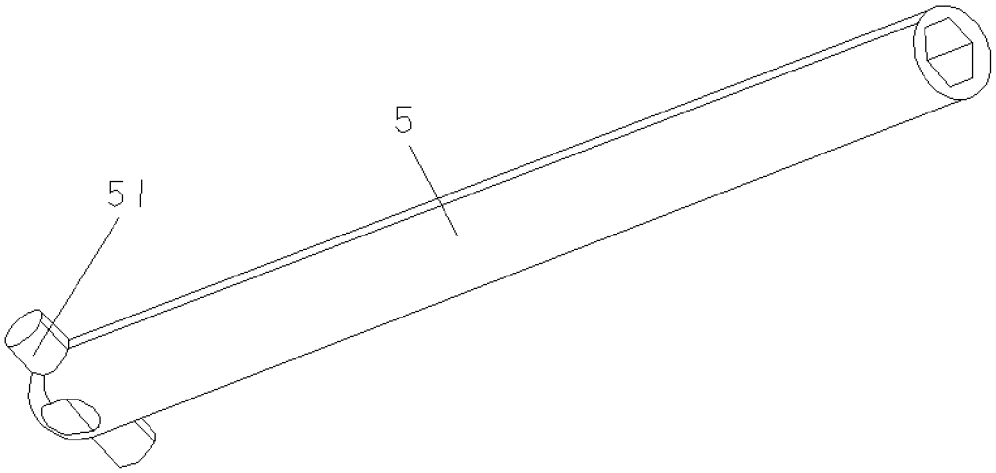
FIG. 4 shows a structure diagram of the matching shaft of the multifunctional screwdriver of the present patent application.
Figure 5:
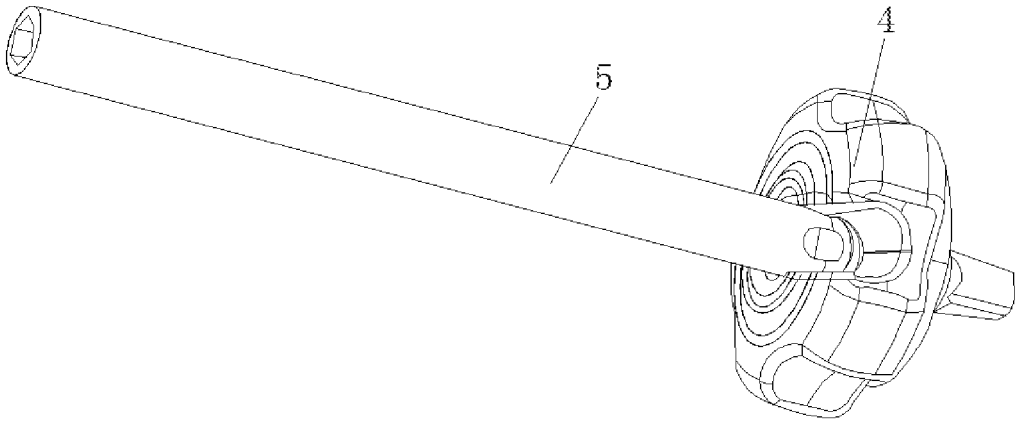
FIG. 5 shows an assembly diagram of the ratchet head and the matching shaft of the multifunctional screwdrivers of the present patent application.
Figure 6:
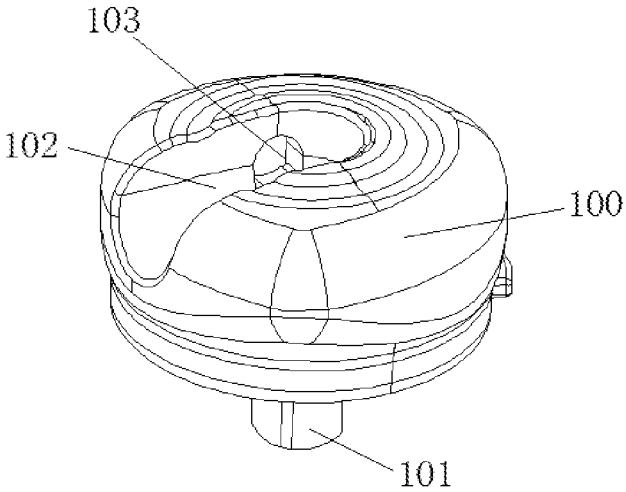
FIG. 6 shows a structure diagram of another ratchet head of the multifunctional screwdriver of the present patent application.

Users can further understand the characteristics and functions of the present patent application according to the following illustrations, In this embodiment, ratchet head 4 is provided with a gap structure 41, two circular holes 42 are provided at the center of the ratchet head 4, a connecting hole 31 is provided at the end surface of the matching shaft 5, an embossment 51 is provided at two sides of the other end, one end of the matching shaft 5 which has said embossment 51 is connectable to the ratchet head 4 (as shown in FIG. 1), the size of the gap structure 41 is matched with the diameter of the matching shaft 5, which allows the matching shaft 5 to be rotated at a 90 degree. when the matching shaft, the ratchet head and the handle are assembled as FIG. 1 shows, the user can fasten screws in the vertical direction, the configuration as shown in FIG. 1 can increase the torque of the screwdriver, and also can reduce the power output of users, and thus save users' physical capacity; when the matching shaft, the ratchet head, and the handle are assembled as FIG. 2 shows, protrusion can be inserted in the shape-matching hole 24 of the handle 2, which allows to use the screwdriver under a working condition of narrow space, and thus the work efficiency is improved.

Therefore, the ratchet head can be matched with the handle to use as a ratchet wrench or a screwdriver, and alternatively, the ratchet head also can be used singly as a palm ratchet wrench.

Moreover, this embodiment also provides a ratchet head 100 with another structure, the ratchet head 100 has a triangular structure, the bottom of the ratchet head is provided with a protrusion 101, the ratchet head is provided with a matching hole 102 inside, two circular holes 103 which are opposite to each other are provided inside the matching hole 102, the matching hole 102, the circular hole 103 and the matching shaft 5 are matched with each other and assembled, which has the same technical effect as the assembly of ratchet head 100, handle 2 and matching shaft 5 mentioned above, as the certain implementation method is the same as that of the structure mentioned above, so it will not be described here.

The above mentioned is merely the better embodiment of the patent application, the implementation method and the protection scope of the patent application are not limited by that, for artisan in this field, it is to be understood that the equivalent replacement and the obvious change of the specification and the illustrations of the present patent application shall be included in the protection scope of the present patent application.

What is claimed is:

1. A multifunctional screwdriver comprising:

a ratchet head;

a matching shaft;

a handle;

the ratchet head comprising a center, a bottom side, a peripheral side, an upper side, a plurality of flanges, a plurality of grooves, a matching hole, two circular holes and a protrusion;

the peripheral side being perimetrically connected in between the bottom side and the upper side;

the plurality of flanges and the plurality of grooves being formed on the peripheral side;

each of the plurality of grooves being located in between two correspondingly adjacent flanges among the plurality of flanges;

the matching hole laterally traversing from the peripheral side into the center;

the matching hole axially traversing from the upper side into the center;

the matching hole and one of the plurality of grooves being coincided with each other;

the two circular holes being oppositely located to each other;

the two circular holes being internally located at the center;

each of the two circular holes being laterally communicated with the matching hole;

the matching hole being located in between the two circular holes;

the protrusion being axially connected with the bottom;

the matching shaft comprising a first end, a second end, two embossments and a connecting hole;

the first end and the second end being oppositely located to each other;

the first end being axially inserted into the matching hole;

each of the two embossments being laterally connected with the first end;

the two embossments being oppositely located to each other;

each of the two embossments being laterally inserted into a corresponding circular hole among the two circular holes;

the connecting hole axially traversing into the second end;

the handle comprising a front end surface, a back end surface, a mounting hole and a shape-matching hole;

the front end surface and the back end surface being oppositely located to each other;

the mounting hole axially traversing into the front end surface;

the mounting hole being configured to be matched with the second end;

the shape-matching hole axially traversing into the back end surface; and the shape-matching hole being configured to be matched with the protrusion.

2. The multifunctional screwdriver as disclosed in claim 1, wherein the handle has a columnar structure in direction of length, and one end of the handle is concave and curved inwards.

3. The multifunctional screwdriver as disclosed in claim 1, wherein the matching hole is matched with the first end in diameter size.

4. The multifunctional screwdriver as disclosed in claim 1, wherein the shape-matching hole is matched with the protrusion in diameter size.

* * * * *